United States Patent [19]

Iytaka et al.

[11] 4,169,733

[45] Oct. 2, 1979

[54] PROCESS FOR FORMING HIGH-CONTRAST SILVER IMAGES

[75] Inventors: Tateshi Iytaka; Syunji Matsuo; Toshio Nagatani; Kazuo Takahashi; Takeshi Habu, all of Hino, Japan

[73] Assignee: Konishiroku Photo Industry Co., Ltd., Tokyo, Japan

[21] Appl. No.: 871,348

[22] Filed: Jan. 23, 1978

[30] Foreign Application Priority Data

Feb. 1, 1977 [JP] Japan ..... 52-9918

[51] Int. Cl.[2] ..... G03C 5/26; G03C 5/30; G03C 1/06

[52] U.S. Cl. ..... 96/50 PT; 96/66.5; 96/95; 96/107; 96/114.5; 96/66 HD

[58] Field of Search ..... 96/95, 66, 66.5, 50 PT, 96/107, 109, 114.5

[56] References Cited

FOREIGN PATENT DOCUMENTS 2634666 2/1977 Fed. Rep. of Germany ..... 96/95

*Primary Examiner*—Mary F. Kelley

*Attorney, Agent, or Firm*—Flynn & Frishauf

[57] ABSTRACT

Process for forming high-contrast silver images which comprises treating a light-sensitive silver halide photographic material provided with a hydrophilic colloidal layer containing a silver halide emulsion layer coated on a support and containing a tetrazolium compound, after imagewise exposure, with a developer and/or a processing solution prior to the developing, both of which contains at least a nitrogen-containing heterocyclic compound substituted with at least mercapto, thioketone or thioether group.

13 Claims, No Drawings

PROCESS FOR FORMING HIGH-CONTRAST SILVER IMAGES

The invention relates to a process for forming a high contrast silver image by processing rapidly a light-sensitive silver halide photographic material. Particularly, it relates to a process for forming a high contrast silver image capable of forming a silver image consisting of dots with high contrast and quality and of speeding up the total processes by shortening the developing period greatly.

More particularly, it relates to a process for forming a high contract silver image which is advantageously applied to novel high contract light-sensitive silver halide photographic materials such as lith type (printing) light-sensitive silver halide material or photocopy type light-sensitive silver halide photographic material fit for forming dot- or line-image, and which enables rapid processing by shortening the developing period.

It has been known to form a photographic image with having an extremely high contrast by using some kind of a light-sensitive silver halide photographic material.

It has been known, for example, to obtain a high contrast image, e.g. a line- or dot-image, by processing, with an alkaline hydroquinone developing solution containing sulfite ions in a very low concentration, a light-sensitive material which comprises a silver chlorobromide emulsion containing silver chloride in a high content (at least more than 50 mole %), the grains of which emulsion being minute (average grain size; ca. 0.2$\mu$), uniform in shape, and the grain size distribution thereof being narrow. The above-mentioned kind of light-sensitive silver halide material is known as the lith type light-sensitive material In printing business, there is usually required a process to convert a continuous gradation original image to a dot image, i.e. a process to convert the densities of the continuous gradation to a predetermined numbered assembly of dots respectively having area of the same densities but proportional in size to the densities of the continuous gradation. In order to carry out this, the lith type light-sensitive material is subjected to development, after photographing the original image through a cross- or contact-screen, to form the dot image on the light-sensitive material.

For this purpose, there has been employed a light-sensitive silver halide photographic material containing a silver halide emulsion, the grains of which being minute and being uniform in size and shape. Even when this kind of a light-sensitive silver halide photographic material is employed, the intermediate density region is reproduced, in addition to the maximum density region and the minimum one (fog), when the material is processed with a standard black and white developing solution. The intermediate density region or the so-called fringe is undesirable for producing printing plates and makes the dot quality worse.

There has heretofore been employed the lith type light-sensitive material also for the reproduction of a line image. For the same reason, however, there have been obtained images having at best the $\gamma$-value of 5–6 of the characteristic curve, which is lower than the 7–9 required for forming the desirable line image, if the standard black and white developing solution is employed. In order to avoid this, there has been employed, as mentioned above, a specific developing solution called "infectious developing solution".

Here, the term infectious developing solution, or lith type developing solution, means a developing solution in which hydroquinone is substantially and solely the developing agent and sulfite ions are contained in low concentration, as specifically described in J. A. C. Yule, Journal of the Franklin Institute, vol. 239, p. 221 (1945).

As can be expected from the composition, it is inevitable that the control system for obtaining a negative or positive dot with high quality constantly becomes complicated because the lith type developing solution is liable to be auto-oxidized and has a poor preservability.

Further, there remains a problem of processing efficacy since the speed of developing is insufficient.

Although much effort has been made to improve the preservability of lith type developing solution, there have been found no developing solutions, with which a high dot quality is obtained, having a preservability comparable to a continuous gradation developing solution, e.g. Metol/hydroquinone developing solution or phenidone/hydroquinone developing solution.

It is the first object of the invention to provide a process for forming a high contrast silver image by processing a novel light-sensitive silver halide photographic material to obtain a high contrast silver image.

It is the second object of the invention to provide a process for forming a high contrast silver image capable of obtaining a line- or dot-image with high quality, by processing a light-sensitive silver halide photographic material containing a tetrazolium compound.

It is the third object of the invention to provide a process for forming a high contrast silver image, enabling a rapid processing by shortening the developing period, while maintaining the high contrast.

It is the fourth object of the invention to provide a process for forming a high contrast silver image by using a developing solution having superior light-, oxidation- and fatigue-resistance, and therefore, having good preservability.

It is the fifth object of the invention to provide a process for forming a high contrast silver image which employs a developing solution (and/or a processing solution prior to the developing) which needs no change of the prescribed developing period even when a light-sensitive silver halide photographic material is processed in large amounts; and which needs less supply solution for recycling.

It is the sixth object of the invention to provide a process for forming a high contrast silver image which has a broad developing latitude sufficient for obtaining a practical dot quality easily.

The above-mentioned objects as well as other objects of the invention may be attained by processing a light-sensitive silver halide photographic material containing a tetrazolium compound, the material comprising a hydrophilic colloidal layer containing a silver halide emulsion layer coated on a support, with a developing solution and/or a processing solution prior to the developing, containing at least a nitrogen-containing heterocyclic compound whose ring is substituted with at least a mercapto, thioketone or thioether group (nitrogen-containing heterocyclic compounds, the rings of which are substituted with at least a methyl, hydroxymethyl or nitro group, are excluded).

The inventors have found previously that a high contrast silver image may be formed by processing a light-sensitive silver halide photographic material containing a tetrazolium compound within at least a layer of the hydrophilic colloidal layers, after imagewise exposure, with a developing solution containing a hydroquinone series or a non-hydroquinone series developing agent.

The inventors have found, after further studies of the developing process, that not only a silver image with an extremely superior dot quality may be obtained but also the developing period may be shortened, while maintaining the high contrast and the developing stability and preservability (i.e. light-, oxidation- and developing fatigue-resistance may be remarkably improved) by incorporating at least one specific compound, i.e. a nitrogen-containing heterocyclic compound whose ring is substituted with at least a mercapto, thioketone or thioether group (hereinafter referred to as the nitrogen-containing heterocyclic compound of the invention), provided those substituted in the heterocyclic ring at least with a methyl, hydroxymethyl or nitro group are excluded in the invention, into the developing solution and/or the processing solution prior to the developing.

The inventors have found further that the photographic performance may not be influenced by a mixing of the fixing solution into the developing solution, when the developing solution and/or the processing solution prior to the developing, containing a nitrogen-containing heterocyclic compound of the invention is employed.

Namely, so-called reverse mixing takes place and, particularly in case of lith developing, the optimum developing point moves and thus greatly influences remarkably the photographic performance, when a light-sensitive silver halide photographic material is conveyed continuously with an automatic developer.

Whereas, according to the invention, the optimum developing point is kept stable and no movement thereof is observed.

Furthermore, it has turned out according to the invention that no oxidation product of the developing agent is accumulated due to improved preservability of the developing solution and thus color pollution of the processed light-sensitive silver halide photographic material may be prevented; no insoluble substances, such as sludge, precipitate in the developing solution even when a light-sensitive silver halide photographic material is processed in large amount; and a broad developing latitude fit for production of practical dot quality may be obtained.

There is no specific limitation as to the nature of the nitrogen-containing hetercyclic compound of the invention to be contained in the developing solution and/or the processing solution prior to the developing, so long as it is a nitrogen-containing heterocyclic compound whose ring is substituted with at least a mercapto, thioketone or thioether group (those whose rings are substituted with at least a methyl, hydroxymethyl or nitro group are excluded from the invention).

Preferably, the ring of the nitrogen-containing heterocyclic compound of the invention is selected from imidazoline-, imidazole-, imidazolone-, pyrazoline-, pyrazol-, pyrazolone-, oxazoline-, oxazole-, oxazolone-, thiazoline-, thiazole-, thiazolone-, selenazoline-, selenazole-, selenazolone-, oxadiazole-, thiadiazole-, triazole-, tetrazole, benzimidazole-, benzotriazole-, indazole-, benzoxazole-, benzothiazole-, benzoselenazole-, pyrazine-, pyrimidine-, pyridazine-, triazine-, oxazine-, thiazine-, tetrazine-, quinazoline-, phthalazine- and polyazaindene (e.g. triazaindene-, tetraazaindene- or pentaazaindene) rings.

More preferably, a nitrogen-containing heterocyclic compound of the invention is represented by the following formulae [IV] or [V]:

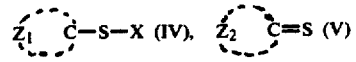

wherein, $Z_1$ and $Z_2$ each represent atoms or atomic groups necessary for forming the above-illustrated preferable imidazoline- to polyazaindene rings; X represents a hydrogen atom, an alkyl group (e.g. methyl, ethyl, propyl, isopropyl, hydroxyethyl, methoxyethyl, acetoxyethyl, carboxymethyl, carboxyethyl, ethoxycarbonylmethyl, sulfoethyl, sulfopropyl, sulofbutyl, β-hydroxy-γ-sulfopropyl, sulfatepropyl or benzyl, etc.), or an arylgroup (e.g. phenyl, carboxyphenyl, sulfophenyl, tolyl, α-naphthyl or β-phenyl, etc.

The following are specific, but non-limiting examples of the nitrogen-containing heterocyclic compounds of the invention preferably employed in the invention:

(1)

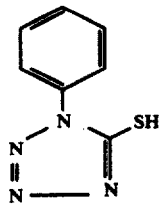

(2)

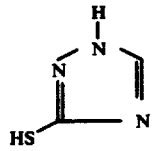

(3)

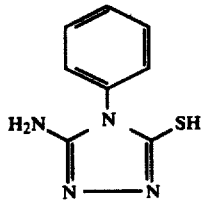

(4)

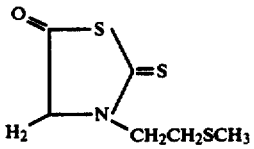

(5)

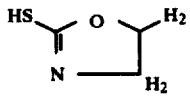

(6)

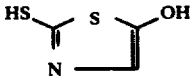

(7)

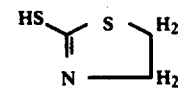

(8)

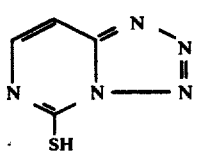

-continued
(9)
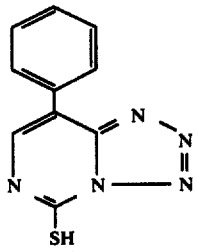
(10)
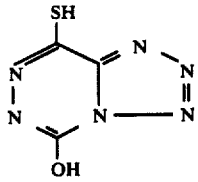
(11)
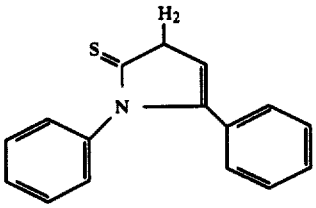
(12)
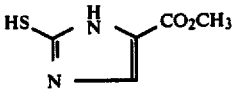
(13)
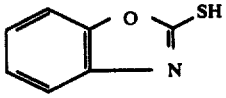
(14)
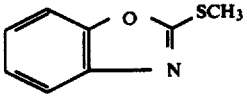
(15)
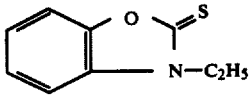
(16)
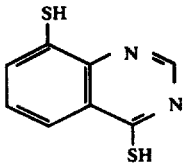
(17)
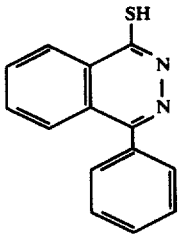
(18)
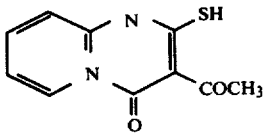
(19)
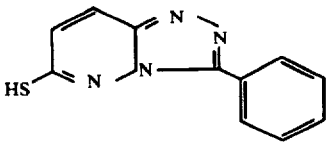
-continued
(20)
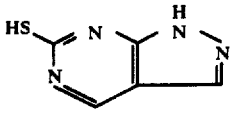
(21)
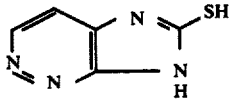
(22)
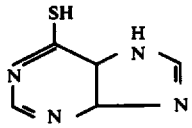
(23)
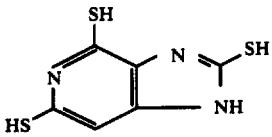
(24)
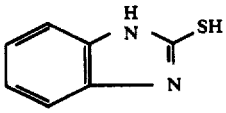
(25)
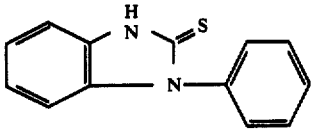
(26)
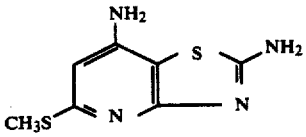
(27)
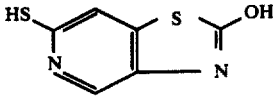
(28)
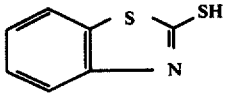
(29)
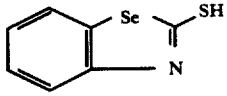
(30)
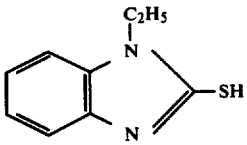
(31)
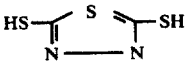
(32)
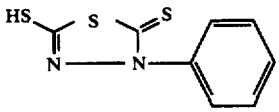
(33)
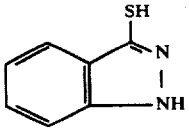

-continued (34)

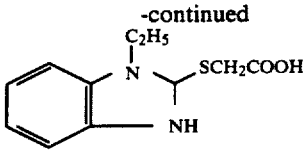

(35)

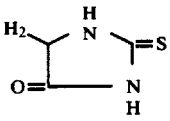

(36)

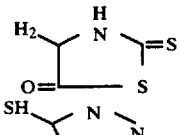

(37)

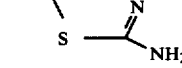

(38)

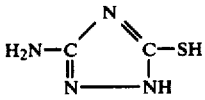

(39)

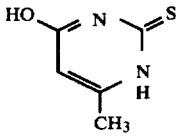

(40)

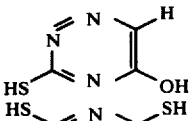

(41)

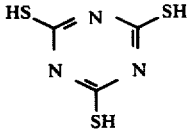

(42)

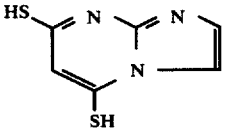

(43)

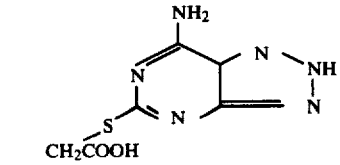

(44)

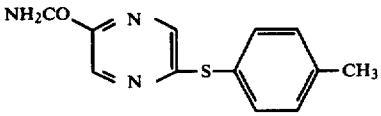

(45)

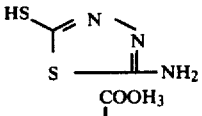

(46)

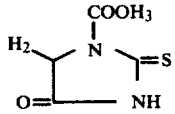

Although the nitrogen-containing heterocyclic compounds of the invention are not limited to those illustrated above, 1-phenyl-5-mercaptotetrazole, 2-mercaptobenzoxazole, 2-mercaptobenzimidazole and 2-mercaptobenzothiazole are the most preferred of the aforeidentified compounds.

At least one nitrogen-containing heterocyclic compound of the invention is used in the developing solution or the processing solution prior to the developing. Eventually, two or more compounds may be used in combination, depending on the varieties of light-sensitive silver halide photographic material to be processed and on the developing conditions.

The nitrogen-containing heterocyclic compounds of the invention may readily be synthesized according to the methods described in, e.g. U.S. Pat. Nos. 3,266,897; 3,251,691; 2,843,491; 3,615,616; 3,641,046; 3,645,618; 3,252,799; 3,330,657; 2,534,599 and 3,114,637; British Pat. Nos. 1,141,773; 1,007,020; 928,840; 868,242; 1,033,698; 1,207,855; 1,037,646; 1,002,323 and 859,143.

Alternatively, it may readily be synthesized according to the methods described in the literature, e.g. "Kartsthek der Thiazol Verbindungen" (published by Basel Verlag von s. Karger, 1952) or A. Weissberger, "The Chemistry of heterocyclic compounds" (N.Y. Interscience, 1950~1964).

The amount of the nitrogen-containing heterocyclic compound of the invention added is not critical, but is 0.1 mg~5 g per liter, preferably 0.5 mg~2 g per liter when contained in the developing solution, and is 0.1 mg~5 g per liter, preferably 0.5 mg~2 g per liter, more preferably 1 mg~1.5 g per liter when contained in the processing solution prior to the developing.

The nitrogen-containing heterocyclic compound of the invention used is contained in the developing solution or the processing solution prior to the developing (hereinafter referred to as pre-bath) and may readily be added thereto, e.g. by the following methods because it has very good solubility and little foaming property. Namely, it may be added to the developing solution or pre-bath, by dissolving it in an aqueous acidic or alkaline solution (e.g. acetic acid or aqueous sodium hydroxide solution) or in an organic solvent such as ethyleneglycols, ethanolamines or alcohol. Alternatively, it may be added to the developing solution or the pre-bath, by dissolving it in an anionic, nonionic, cationic or amphoteric surfactant or by micell dispersing it in the above-mentioned surfactant.

Representative and non-limiting examples of the developing solution and pre-bath preferably used in the invention and containing a nitrogen-containing heterocyclic compound of the invention are given below:

1. Examples of the developing solution

| | |
|---|---|
| [developing solution 1] | |
| Metol | 3.5 g |
| anhydrous sodium sulfite | 40 g |
| hydroquinone | 9 g |
| sodium carbonate monohydrate | 50 g |
| potassium bromide | 2.5 g |
| triethyleneglycol | 20 g |
| water | to make 1 litre (pH = 10.20) |
| [developing solution 2] | |
| Metol | 8 g |
| anhydrous sodium sulfite | 60 g |
| sodium carbonate monohydrate | 54 g |
| potassium bromide | 2.5 g |
| water | to make 1 litre (pH = 10.20) |
| [developing solution 3] | |
| phenidone | 0.3 g |
| hydroquinone | 10 g |
| anhydrous sodium sulfite | 40 g |
| sodium carbonate monohydrate | 20 g |
| potassium bromide | 3 g |
| disodium ethylenediaminetetraacetate | 1 g |
| triethanolamine 30 g | |
| water | to make 1 litre |

-continued

| | |
|---|---|
| | (pH = 10.25) |

2. Examples of pre-bath

| | |
|---|---|
| [pre-bath 1] | |
| disodium ethylenediaminetetraacetate | 1 g |
| anhydrous sodium sulfite | 10 g |
| triethanolamine | 20 g |
| water | to make 1 litre (pH = 10.0) |
| [pre-bath 2] | |
| disodium ethylenediaminetetraacetate | 1 g |
| sodium carbonate monohydrate | 10 g |
| potassium bromide | 3 g |
| sodium sulfite | 10 g |
| triethyleneglycol | 30 g |
| water | to make 1 litre (pH = 10.5) |

There may be employed various kinds of developing agents, solely or jointly, in the developing solution of the invention.

As the developing agents to be used, are included, e.g. organic or inorganic developing agents or auxiliary developing agents, solely or jointly, described in e.g. E. K. Mees and T. H. James, "The Theory of the Photographic Process" 3rd ed., pp 278–381 (1966). Preferred are ferrous oxalate, hydroxylamine, N-hydroxymorpholine, hydroquinones such as hydroquinone, hydroquinone monosulfonate, chlorohydroquinone or t-butylhydroquinone, catechol, resorcinol, pyrogallol, amidole, pyrazolidones such as phenidone, p-aminophenols such as p-aminophenol, glycine or Metol, p-phenylenediamines such as p-phenylenediamine or 4-amino-N-ethyl-N-ethoxyaniline, ascorbic acid or the like. More preferred are Metol, combinations of phenidone and Metol, phenidone and hydroquinone, Metol and hydroquinone, phenidone, Metol and t-butylhydroquinone, phenidone and ascorbic acid, or phenidone and p-aminophenol.

It is possible that similar good results may be obtained by using more diverse combinations.

The developing agent contained in the developing solution of the invention is used in a conventional concentration, i.e. $10^{-5} \sim 1$ mole per liter of the developing solution.

A sulfite preservative such as sodium sulfite, potassium sulfite, or ammonium sulfite may jointly be employed in the developing solution used in the invention without impairing the effects of the invention. This is another characteristic of the invention. The sulfite is contained preferably in an amount of $10^{-2} \sim 10^{-1}$ mole per liter. Similarly, hydroxylamine or hydrazides may also be employed as a preservative.

There may optionally be added to the developing solution an alkali hydroxide, alkali borate, alkali carbonate or amine to adjust pH and to give buffer function; an inorganic or organic developing retarder such as potassium bromide; a heavy metal sequestering agent (water softener) such as ethylenediaminetetraacetic acid; a hardener such as formalin, glyoxal or glutaraldehyde; a surfactant such as sodium dodecylbenzenesulfonate; a developing accelerator such as polyethyleneglycol oleate; or a coloring coupler such as 2,4-dibromo-α-naphthol.

Furthermore, a contrast agent or a toe-part reducing agent often used for the conventional high contrast developing solution may be added without undesirably influencing on the photographic quality.

As mentioned above, the developing solution of the invention contains a developing agent selected from known silver halide developing agents with no structural, physical or chemical limitation, and may further contain various kinds of photographic additives.

It is desirable that the developing solution of the invention has a pH value of $8.5 \sim 12$.

The process of the invention comprises processing a light-sensitive silver halide photographic material containing a tetrazolium compound (hereinafter referred to as the light-sensitive silver halide photographic material of the invention), after imagewise exposure, with a developing solution and/or pre-bath containing at least a nitrogen-containing heterocyclic compound of the invention.

For example, the temperature at which the developing or pre-bathing is carried out is preferably not more than 50° C., more preferably around 30° C., and the time required for developing is within 5 minutes, in general, preferably within 2 minutes, by which good results are often obtained. After the developing, the subsequent processes such as washing, stopping, stabilizing and fixing, and if necessary, prehardening and neutralization are performed, using conventional processing solutions employed for the processes.

The processes may be carried out either by the so-called manual processing such as bath- or tray-development, or by the automatic processing such as roller- or hanger-development.

According to a preferred embodiment of the invention, the processing solution in the bath development was more than 30 times more stable over a period than the conventional lith type developing solution. When the known particular developing solution containing sulfite ion in an extremely low concentration is employed in order to improve the dot quality of the lith type light-sensitive material, it became of no use within several hours. Whereas, according to a preferred method of the invention, the processing solution could be stably employed after three months have passed, and the dot quality using the solution was then comparable to that using a newly prepared solution. When the pre-bath containing a nitrogen-containing heterocyclic compound of the invention is used, it is desirable that the process with the pre-bath be performed immediately before the process with the developing solution, though other processes may be performed inbetween.

As can be understood by the above description, the invention relates to novel procession of light-sensitive silver halide photographic material affording a superior line- or dot-quality, by processing a light-sensitive silver halide photographic material containing a tetrazolium compound, with a developing solution and/or pre-bath containing a nitrogen-containing heterocyclic compound of the invention.

In accordance with the process of the invention, a superior high contrast silver image may be obtained when a diffusible tetrazolium compound is used. When a non-diffusible tetrazolium compound is used, a dot image which is more superior than that obtained in accordance with the method disclosed in Japanese Patent application No. 50–94295 may be obtained.

The light-sensitive silver halide photographic material used for forming a high contrast silver image according to the invention will be explained as follows.

The light-sensitive silver halide photographic material of the invention is a light-sensitive silver halide photographic material containing a diffusible or non-diffusible tetrazolium compound, and a hydrophilic colloidal layer containing a silver halide emulsion layer is coated on a support.

The tetrazolium compound of the invention is preferably contained within the hydrophilic colloidal layer containing the silver halide emulsion layer. More concretely, it is contained within the silver halide emulsuion layer and/or a directly or indirectly adjacent layer thereto. Alternatively, the tetrazolium compound of the invention may be coated direct on the outer layer of the light-sensitive photographic material, or on the outer layer of the material upon preparation by means of overcoat method, or the like, by dissolving the tetrazolium compound in an appropriate organic solvent.

It is desirable that the silver halide contained in the silver halide emulsion layer has a mean grain size of 0.05~0.8μ.

In this invention, the term "non-diffusible tetrazolium compound" means a compound which does not dissolve from the light-sensitive material to the developing solution during the development. In other words, the compound does not dissolve in a concentration of several %, preferably not more than 2%, when a gelatin layer containing the compound is dipped for 10 minutes in an aqueous solution at 20°–40° C. having the same ion strength and pH-value as those of the developing solution.

The representative tetrazolium compounds employed in the invention include the following compounds represented by the general formulae:

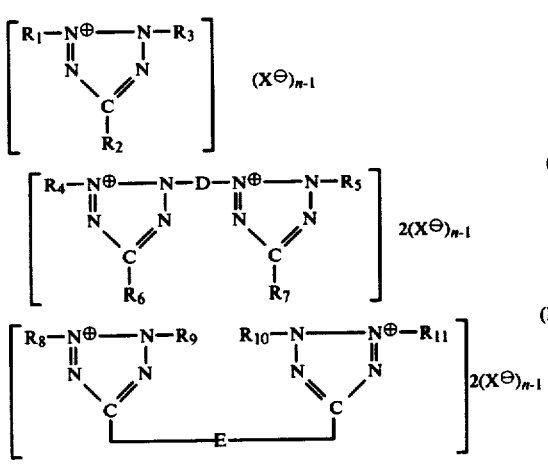

In the above formulae, $R_1$, $R_3$, $R_4$, $R_5$, $R_8$, $R_9$, $R_{10}$ and $R_{11}$ each represent a group selected from an alkyl group e.g. methyl, ethy, propyl or dodecyl etc.), an allyl group, a phenyl group (e.g. phenyl, tolyl, hydroxyphenyl, carboxyphenyl, aminophenyl or mercaptophenyl etc.), a naphthyl group (e.g. α-naphthyl, β-naphthyl, hydroxynaphthyl, carboxynaphthyl or aminonaphthyl, etc.) and a heterocyclic group (e.g. thiazolyl, benzothiazolyl, oxazolyl, pyrimidinyl, pyridyl, etc.). The group can advantageously contain an electron sharing group capable of forming a metal chelate or a complex and; $R_2$, $R_6$ and $R_7$ each represent a group selected from an allyl group, a phenyl group, a naphthyl group, a heterocyclic group, an alkyl group (e.g. methyl, ethyl, propyl, butyl, mercaptomethyl or mercaptoethyl, etc.), hydroxyl, carboxyl or the salt thereof, a carboxyalkyl group (e.g. a methoxycarbonyl or ethoxycarbonyl), an amino group (e.g. amino, ethylamino or anilino), mercapto, nitro and hydrogen; D represents a divalent aromatic group; E represents a group selected from an alkylene group, an arylene group and an aralkylene group; $X^{\ominus}$ is an anion; and n is 1 or 2, provided that the compound forms an intramolecular salt when n is 1.

The following are typical examples of the tetrazolium compounds used in the invention but not intended to limit the salt of tetrazolium compound thereof.

(1) 2-(Benzothiazol-2-yl)-3-phenyl-5-dodecyl-2H-tetrazolium bromide
(2) 2,3-Diphenyl-5-(4-t-octyloxyphenyl)-2H-tetrazolium chloride
(3) 2,3,5-Triphenyl-2H-tetrazolium chloride
(4) 2,3,5-Tri(p-carboxyethylphenyl)-2H-tetrazolium chloride
(5) 2-(Benzothiazol-2-yl)-3-phenyl-5-(o-chlorophenyl)-2H-tetrazolium bromide
(6) 2,3-Diphenyl-2H-tetrazolium chloride
(7) 2,3-Diphenyl-5-methyl-2H-tetrazolium chloride
(8) 3-(p-Hydroxyphenyl)-5-methyl-2-phenyl-2H-tetrazolium bromide
(9) 2,3-Diphenyl-5-ethyl-2H-tetrazolium bromide
(10) 2,3-Diphenyl-5-n-hexyl-2H-tetrazolium bromide
(11) 5-Cyano-2,3-diphenyl-2H-tetrazolium bromide
(12) 2-(Benzothiazol-2-yl)-5-phenyl-3-(4-tolyl)-2H-tetrazolium bromide
(13) 2-(Benzothiazol-2-yl)-5-(4-chlorophenyl)-3-(4-nitrophenyl)-2H-tetrazolium chloride
(14) 5-Ethoxycarbonyl-2,3-di(3-nitrophenyl)-2H-tetrazolium chloride
(15) 5-Acetyl-2,3-di(p-ethoxyphenyl)-2H-tetrazolium bromide
(16) 2,5-Diphenyl-3-(p-tolyl)-2H-tetrazolium chloride
(17) 2,5-Diphenyl-3-(p-iodophenyl)-2H-tetrazolium chloride
(18) 2,3-Diphenyl-5-(p-diphenyl)-2H-tetrazolium chloride
(19) 5-(p-Bromophenyl)-2-phenyl-3-(2,4,6-trinitrophenyl)-2H-tetrazolium chloride
(20) 3-(p-Hydroxyphenyl)-5-(p-nitrophenyl)-2-phenyl-2H-tetrazolium chloride
(21) 5-(3,4-Dimethoxyphenyl)-3-(2-ethoxyphenyl)-2-(4-methoxyphenyl)-2H-tetrazolium chloride
(22) 5-(4-Cyanophenyl)-2,3-diphenyl-2H-tetrazolium chloride
(23) 3-(p-Acetamidophenyl)-2,5-diphenyl-2H-tetrazolium bromide
(24) 5-Acetyl-2,3-diphenyl-2H-tetrazolium bromide
(25) 5-(Fur-2-yl)-2,3-diphenyl-2H-tetrazolium chloride
(26) 5-(Thien-2-yl)-2,3-diphenyl-2H-tetrazolium chloride
(27) 2,3-Diphenyl-5-(pyrid-4-yl)-2H-tetrazolium chloride
(28) 2,3-Diphenyl-5-(quinol-2-yl)-2H-tetrazolium bromide
(29) 2,3-Diphenyl-5-(benzoxazol-2-yl)-2H-tetrazolium bromide
(30) 2,3-Diphenyl-5-nitro-2H-tetrazolium bromide
(31) 2,2',3,3'-Tetraphenyl-5,5'-1,4-butylene-di-(2H-tetrazolium) bromide
(32) 2,2',3,3'-Tetraphenyl-5,5'-p-phenylene-di-(2H-tetrazolium) bromide
(33) 2-(4,5-Dimethylthiazol-2-yl)-3,5-diphenyl-2H-tetrazolium bromide

(34) 3,5-Diphenyl-2-(triazin-2-yl)-2H-tetrazolium chloride
(35) 2-(Benzothiazol-2-yl)-3-(4-methoxyphenyl)-5-phenyl-2H-tetrazolium bromide
(36) 2-p-Iodophenyl-3-p-nitrophenyl-5-phenyl-2H-tetrazolium chloride
(37) 2-(Benzothiazol-2-yl)-3-phenyl-5-dodecyl-2H-tetrazolium stearate
(38) 2,3-Diphenyl-5-(4-t-octyloxyphenyl)-2H-tetrazolium laurate
(39) 2,3,5-Triphenyl-2H-tetrazolium di-2-ethylhexylsulfasuccinate
(40) 2,3,5-Tri(p-carboxyethylphenyl)-2H-tetrazolium stearate
(41) 2-(Benzothiazol-2-yl)-3-phenyl-5-(o-chlorophenyl) 2H-tetrazolium p-dodecylbenzenesulfonate
(42) 2,3-Diphenyl-2H-tetrazolium di-2-ethylhexylsulfosuccinate
(43) 2,3-Diphenyl-5-methyl-2H-tetrazolium p-octylbenzenesulfonate
(44) 3-(p-Hydroxyphenyl)-5-methyl-2-phenyl-2H-tetrazolium stearate
(45) 2,3-Diphenyl-5-ethyl-2H-tetrazolium di-3-methylnonylsulfonate
(46) 2,3-Diphenyl-5-n-hexyl-2H-tetrazolium p-octadecylbenzenesulfonate
(47) 5-Cyano-2,3-diphenyl-2H-tetrazolium di-2-ethylhexylsulfosuccinate
(48) 2-(Benzothiazol-2-yl)-5-phenyl-3-(4-tolyl)-2H-tetrazolium p-dodecylbenzenesulfonate
(49) 2-(Benzothiazol-2-yl)-5-(4-chlorophenyl)-3-(4-nitrophenyl)-2H-tetrazolium di-isopropylnaphthalenesulfonate
(50) 5-Ethoxycarbonyl-2,3-di(3-nitrophenyl)-2H-tetrazolium stearate
(51) 5-Acetyl-2,3-di(p-ethoxyphenyl)-2H-tetrazolium laurate
(52) 2,5-Diphenyl-3-(p-tolyl)-2H-tetrazolium stearate
(53) 2,5-Diphenyl-3-(p-iodophenyl)-2H-tetrazolium laurate
(54) 2,3-Diphenyl-5-(p-diphenyl)-2H-tetrazolium di-isopropyl naphthalenesulfonate
(55) 5-(p-Bromophenyl)-2-phenyl-3-(2,4,6-trichlorophenyl)-2H-tetrazolium di-isopropylnaphthalene-di-sulfonate
(56) 3-(p-Hydroxyphenyl)-5-(p-nitrophenyl)-2-phenyl-2H-tetrazolium p-dodecylbenzenesulfonate
(57) 5-(3,4-Dimethoxyphenyl)-3-(2-ethoxyphenyl)-2-(4-methoxyphenyl)-2H-tetrazolium di-2-ethylhexylsulfosuccinate
(58) 5-(4-Cyanophenyl)-2,3-diphenyl-2H-tetrazolium laurate
(59) 3-(p-Acetamidophenyl)-2,5-diphenyl-2H-tetrazolium stearate
(60) 5-Acetyl-2,3-diphenyl-2H-tetrazolium p-octadecylbenzenesulfonate
(61) 5-(Fur-2-yl)-2,3-diphenyl-2H-tetrazolium di-2-ethylhexylsulfonate
(62) 5-(Thien-2-yl)-2,3-diphenyl-2H-tetrazolium stearate
(63) 2,3-Diphenyl-5-(pyrid-4-yl)-2H-tetrazolium laurate
(64) 2,3-Diphenyl-5-(quinol-2-yl)-2H-tetrazolium stearate
(65) 2,3-Diphenyl-5-(benzoxazol-2-yl)-2H-tetrazolium laurate
(66) 2,3-Diphenyl-5-nitro-2H-tetrazolium di-isopropylnaphthalenesulfonate
(67) 2,2',3,3'-Tetraphenyl-5-5'-1,4-butylene-di-(2H-tetrazolium) di-3-propyl-nonylsulfonate
(68) 2,2',3,3'-Tetraphenyl-5-5'-p-phenylene-di-(2H-tetrazolium) p-dodecylbenzenesulfonate
(69) 2-(4,5-Dimethylthiazol-2-yl)-3,5-diphenyl-2H-tetrazolium stearate
(70) 3,5-Diphenyl-2-(triazin-2-yl)-2H-tetrazolium laurate
(71) 2-(Benzothiazol-2-yl)-3-(4-methoxyphenyl)-5-phenyl-2H-tetrazolium p-tolylsulfonate
(72) 2-p-Iodophenyl-3-p-nitrophenyl-5-phenyl-2H-tetrazolium di-isopropylnaphthalene-di-sulfonate
(73) 2,3,5-Triphenyl-2H-tetrazolium di-isopropylnaphthalene-di-sulfonate Among the diffusible and non-diffusible tetrazolium compounds, 2,3,5-triphenyl-2H-tetrazolium series compounds are preferably used in the invention.

Joint use of plural tetrazolium compounds may bring about more preferable characteristics.

For instance, particularly a preferable combination in the invention is a combination of a compound obtained from 2,3,5-triphenyl-2H-tetrazolium chloride and 2,5-diphenyl-3-(p-iodophenyl)-2H-tetrazolium or 2,3,5-triphenyl-2H-tetrazolium and diisopropylnaphthalenedisulfonic acid; and a compound obtained from 2-p-iodophenyl-3-p-nitrophenyl-5-phenyl-2H-tetrazolium and diethylhexylsuccinate sulfonic acid, which produces a good result, e.g. broad developing latitude.

When the tetrazolium compound of the invention is used as the non-diffusible type, the non-diffusible compound obtained by reacting the above-illustrated diffusible compound with an anion is used.

As the anion moiety are mentioned, e.g. a higher alkylbenzenesulfonate anion such as p-dodecylbenzenesulfonate anion, a higher alkylsulfate ester anion such as laurylsulfate anion, a dialkylsulfosuccinate anion such as di-2-ethylhexylsulfosuccinate anion, a polyetheralcoholsulfate ester anion such as cetylpolyethenoxysulfate anion, a higher fatty acid anion such as stearic acid anion, or a polymeric anion such as polyacrylic acid anion or the like.

The non-diffusible tetrazolium compounds according to the invention are thus synthesized by an optional selection of the anionic and cationic moiety. The non-diffusible compounds, e.g. 2,3,5-triphenyl-2H-tetrazolium dioctylsuccinate-sulfonate, may be dispersed into a gelatin solution by mixing the respective soluble tetrazolium salt and the anion with the gelatin to disperse them in the gelatin matrix to obtain the gelatin solution dispersed with the non-diffusible tetrazolium compound as specifically mentioned in Examples set forth later.

Alternatively, crystals of the oxidizing agent purely synthesized may be dissolved in a suitable solvent such as dimethylsulfoxide and then dispersed in the gelatin solution. When the dispersion is not sufficiently homogeneous, good results may be obtained by exposing the emulsion dispersion to an ultrasonic wave or by use of a suitable homogenizer such as Manton-Gaulin homogenizer.

Among the non-diffusible tetrazolium compounds used in the invention, those obtained from 2,3,5-triphenyl-2H-tetrazolium and diisopropylnaphthalene-disulfonate, 2,3,5-triphenyl-2H-tetrazolium and diethylhexylsuccinate disulfonic acid, and, 2-p-iodophenyl-3-p-nitrophenyl-5-phenyl-2H-tetrazolium and diethylhexylsuccinate disulfonic acid are preferably employed.

As mentioned above, the tetrazolium compounds of this invention may be used both in diffusible and non-diffusible forms. However, the higher contrast image may be obtained by employing the non-diffusible tetrazolium compounds. Accordingly, it is advantageous to employ the non-diffusible tetrazolium compound when an especially superior dot quality is required.

On the other hand, the use of too much high contrast light-sensitive material sometimes brings about insufficient reproduction of the line image, particularly those of fine letters and lines. In this case an image with superior quality may be obtained by the use of the diffusible tetrazolium compounds.

According to a preferred embodiment of the invention, the tetrazolium compound of the invention is incorporated into a silver halide emulsion layer.

According to another preferred embodiment of the invention, the compound is incorporated in a layer adjacent (or a layer adjacent to said adjacent layer) to the layer containing the silver halide emulsion.

The above-mentioned tetrazolium compounds of the invention may preferably be employed in an amount of 0.0001–10 mole, more preferably 0.001–1 mole, per mole of the silver halide contained in the light-sensitive silver halide photographic material of the invention. The silver halide employed for the light-sensitive silver halide photographic material of the invention includes any silver halide used for the conventional silver halide photographic materials, e.g. silver bromide, silver chlorobromide, silver iodobromide, silver chloroiodobromide or silver chloride and the like.

The average grain size of the silver halide in the invention is 0.05–1.5μ, preferably 0.1–0.8μ, more preferably 0.25–0.5μ and at least 75%, preferably more than 80% of the total grains are within a range of 0.6–1.4 times, preferably 0.7–1.3 times larger than the average grain size. Furthermore, the silver halide comprises silver chlorobromide or chloroiodobromide containing at least 50 mole % silver chloride and satisfies the above-mentioned grain size and the distribution thereof. The silver halide of the invention having the above-mentioned average grain size and the distribution thereof may be prepared by any known method described, e.g. in U.S. Pat. Nos. 2,592,250, 3,276,877, 3,317,322, 2,222,264, 3,320,069 and 3,206,313 and in Journal of Photographic Science 12(5), 242–251 (1964).

Silver halides prepared by other methods may also be employed in mixture.

According to the most preferred specific embodiment of the invention, the silver halide of the invention is silver chloroiodobromide or chlorobromide having an average grain size of 0.1–0.8μ, preferably 0.25–0.5μ and at least 80% of the total grains being within a range of 0.7–1.3 times larger than the average grain size.

The silver halide emulsion of the invention may be sensitized with various kinds of chemical sensitizers. As the sensitizer, are mentioned, for example; activated gelatin, sulfur sensitizers (e.g. sodium thiosulfate, aryl thiocarbamide, thiourea or aryl isocyanate, etc.), selenium sensitizers (e.g. N,N-dimethylserenourea or selenourea, etc.), reducing sensitizers (e.g. triethylenetetramine or stannic chloride, etc.) and various noble metal sensitizers represented by potassium chloroaurite, potassium auriothiocyanate, potassium chloroaurate, 2-auro-sulfobenzothiazole methylchloride, ammonium chloropalladate, potassium chloroplatinate and sodium chloropalladite. The sensitizer may be employed alone, or mixed together. Ammonium thiocyanate may be auxiliarily employed when a gold sensitizer is employed.

Furthermore, the silver halide emulsion used in the invention may be sensitized optically with one or more sensitizing dyes to give a light sensitivity within the desired light-sensitive wave length.

Various kinds of sensitizing dyes may be employed for the purpose. As the optical sensitizers employed advantageously in the invention are mentioned, e.g. a cyanine, merocyanine, tri- or tetranuclei merocyanine, tri- or tetranuclei cyanine, styryl, holopolar cyanine, hemicyanine, oxonole, hemioxonole, and the like.

The optical sensitizers preferably contain within the chemical structure thereof a nitrogen-containing heterocyclic nucleus, e.g. a basic group such as thiazoline or thiazole, or rhodanine, thiohydantoin, oxazolidinedione, barbituric acid, thiobarbituric acid or pyrazolone. The nucleus may be substituted with an alkyl, hydroxyalkyl, halogen, phenyl, cyano or alkoxy group or may be fused with a hydrocarbon or heterocyclic ring.

When the optical sensitizers mentioned above, particularly merocyanine dye is employed, not only optical sensitization but also broadening of developing latitude may be achieved.

The silver halide emulsion of the invention may preferably be stabilized with 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo-(1,5-a)pyrimidine, 7-hydroxy-s-triazolo(1,5-a)pyrimidine, 5-methyl-6-bromo-7-hydroxy-s-triazolo(1,5-a)pyrimidine, esters or salts of gallic acid (e.g. isoamyl gallate, dodecyl gallate, propyl gallate or sodium gallate), mercaptans (e.g. 1-phenyl-5-mercaptotetrazole or 2-mercaptobenzothiazole), benzotriazoles (e.g. 5-bromobenzotriazole or 4-methylbenzotriazole) and benzimidazoles (e.g. 6-nitrobenzimidazole). Such stabilizers are described in, e.g. U.S. Pat. Nos. 2,444,607, 2,716,062, 3,512,982, and 3,342,596, German Patent Publications 1,189,380, 2,058,626, 2,118,411 and 2,149,789, Japanese Patent Publication 39-2825, 43-4133, 47-4417 and 49-13566. Furthermore, the silver halide emulsion of the invention may contain a latent image stabilizer such as a sulfur-containing amino acid, or a gradation-adjusting agent such as a cadmium or rhodium salt, described in, e.g. German Patent Publication 2,217,153 and 2,217,895.

It has been known in, e.g. British Pat. No. 775,197 and U.S. Pat. No. 3,488,709, to employ a rhodium or cadmium salt to increase the contrast of silver halide emulsion. However, problems still remain when the rhodium salt is employed. For example, the use of rhodium salt tends to cause an unevenness of the product due to the minute amount added and the narrow allowable range thereof of the salt, and thus makes it difficult to produce stable photographic materials. In case of the cadmium salt, it has to be added as little as possible from an ecological viewpoint, for it is washed out by film-processing and comes finally into the environment. The cadmium salts are known to prevent the metabolism and to be harmful to living tissues. Cadmium may be detected not only in air but also in the body of sea animals. As a result of interest in public health and in the maintenance of normal ecological balance in view of the toxicity of rare metals, including cadmium mentioned above, the inventors have reached the invention relating to a novel method to obtain a light-sensitive material with sufficiently high contrast, even without use of such harmful metals. When the above-mentioned silver halide and tetrazolium compound of the invention are incorporated into the hydrophilic colloidal layer, the hydrophilic colloid advantageously employed in the invention is gelatin. As other hydrophilic colloids than gelatin are mentioned, e.g. colloidal albumin, agar, gum arabic, arginic acid, hydrolyzed cellulose acetate, acrylamide, imidated polyamide, polyvinyl alcohol, hydrolyzed polyvinyl acetate, water-soluble polymer described in, e.g. British Pat. No. 523,661, U.S. Pat. No. 3,341,332, German Patent Publication 2,255,711 and 2,046,682, gelatin derivatives such as phenylcarbamyl gelatin, acylated- or phthalated-gelatin described in, e.g. U.S. Pat. Nos. 2,614,928 and 2,525,753, or graft-polymerized monomers on gelatin having the ethylene group and being capable of polymerization, such as acrylic acid and the ester thereof, styrene, a methacrylic acid and the ester thereof, described in e.g. U.S. Pat. Nos. 2,548,520 and 2,831,767. Such hydrophilic colloids may also be applied to a layer containing no silver halide, e.g. an antihalation layer, a protective layer or an intermediate layer.

The light-sensitive silver halide material of the invention may be prepared by coating the above-mentioned layer containing the silver halide and the tetrazolium compound of the invention on a suitable photographic base. As the representative supports employed in the invention are mentioned, e.g. a baryta paper, a polyethylene-coated paper, a synthetic polypropylene paper, a glass plate, a cellulose acetate or cellulose nitrate film, a polyester film such as a polyethylene terephthalate film, a polyamide film, a polypropylene film, a polycarbonate film, a polystyrene film and the like. The supports are optionally selected depending on the purpose for which the light-sensitive photographic material is used.

Representative light-sensitive silver halide photographic material of the invention comprise at least one hydrophilic colloidal layer, coated on the support, containing a silver halide of this invention and the tetrazolium compound of the invention.

It is preferable in the light-sensitive silver halide photographic material of the invention that a protective layer having a suitable thickness is coated. The protective layer is advantageously a gelatin layer, the thickness of which is preferably 0.1–10μ, more preferably 0.8–2.0μ.

The hitherto known lith type light-sensitive silver halide photographic materials usually have a protective layer. In this invention, however, the protective layer plays an important role different from known ones.

The protective layer is, in general, coated for the purpose to protect the silver halide emulsion layer from incidental mechanical damage during production processes, e.g. cutting, winding or wrapping process, or during photographing and/or processing caused by contact of the light-sensitive material with another substance.

It has turned out that the protective layer of the invention not only protects the above-mentioned silver halide emulsion but also plays an important role for processing stability. That is, while the lith type light-sensitive material has to be able to form a very high contrast line-and dot-image, if a compound oxidizable by a developing agent i.e. the tetrazolium compound, is added in the light-sensitive silver halide photographic material to obtain the above-mentioned high contrast silver image, the above-mentioned tetrazolium compound as the oxidizing agent gives a large influence on the development during the progress thereof and consequently, the quality of the line- or dot-image obtained is largely influenced by the difference of e.g. a developing time, a temperature and an amount of the exposure.

It is not necessarily elucidated in the process of the invention why the presence of the protective layer may act effectively on the stability of the image quality and of the developing process. Presumably, the protective layer may have a function to control adequately the infiltration rate of Metol or phenidone from the processing solution into the light-sensitive material, or the diffusion rate of the tetrazolium compound within the light-sensitive material or therefrom to the processing solution.

This effect is remarkable when the tetrazolium compound of the invention is employed. The effect is not so remarkable when oxidizing agents other than the tetrazolium compound, described in, e.g. Japanese Patent application No. 50-94295 are employed.

Various kinds of photographic additives may optionally be added to the above-mentioned hydrophilic colloidal layer of the invention, as far as they do not impair the effect of the invention. As the additives, are mentioned, e.g. a gelatin plasticizer, a hardening agent, a surface active agent, an image stabilizer, an ultraviolet absorber, an antistaining agent, a pH adjuster, an antioxidant, an antistatic agent, a viscosity-increasing agent, a granularity improving agent, a dye, a mordant, a brightening agent, a development regulator, a matting agent, and the like.

Among the additives mentioned above, the following may particularly and preferably be employed: viscosity-increasing agents and plasticizers, described in U.S. Pat. Nos. 2,960,404 and 3,767,410, German Patent Publication 1,904,604, Belgian Pat. Nos. 558,143 and 762,833, Japanese Patent Publication 43-4939 and 45-15462 and Japanese Patent Provisional Publication 48-63715, e.g. a styrene/sodium maleate copolymer and dextran sulfate, etc; hardening agents of an aldehyde, epoxy, ethyleneimine, active halogen, vinylsulfone, isocyanate, sulfinic acid ester, carbodiimide, a mucochloric acid, or acyloyls, etc.; image stabilizers, e.g. 6,6'-butylidenebis(2-t-butyl)-4-methylphenol) and 4,4'-methylene-bis(2,6-dit-butylphenol), etc.; ultraviolet absorbers, described in, e.g. U.S. Pat. No. 3,253,921, British Pat. No. 1,309,349, Japanese Patent Publication 48-736, 48-5496, 48-41572, 48-30492 and 48-31255, particularly 2-(2-hydroxy-5-t-butylphenyl)-benzotriazole, 2-(2-hydroxy-3,5-di-t-butylphenyl)benzotriazole, 2-(2-hydroxy-3-t-butyl-5-butylphenyl)-5-chlorobenzotriazole and 2-(hydroxy-3,5-di-t-butylphenyl)-5-chlorobenzotriazole; surface active agents for coating aids, emulsifiers, infiltration-improving agents for a processing solution, defoamers, or for controlling various physical properties of the light-sensitive material, described in, e.g. U.S. Pat. Nos. 3,026,202 and 3,514,293, British Pat. Nos. 548,532 and 1,216,389, French Pat. No. 202,588, Belgian Pat. No. 773,459, Japanese Patent Publication 44-26580, 43-17922, 43-17926, 43-13166 and 48-20785 and Japanese Patent Provisional Publication 48-101118, including anionic, cationic, nonionic and amphoteric compounds; mordants described in, e.g. U.S. Pat. Nos. 2,113,381 and 2,548,564; antistaining agents described in, e.g. U.S. Pat. Nos. 2,360,210, 2,728,659, 2,732,300 and 3,700,453, particularly 2-methyl-5-hexadecylhydroquinone 2-methyl-5-sec-octadecylhydroquinone and 2,5-di-t-octylhydroquinone, etc.; antistatic agents described in, e.g. U.S. Pat. Nos. 2,882,157 and 2,972,535, Japanese Patent Publication 46-24159, 46-39312, 48-43809, 49-4853, 49-64 and 47-8742 and Japanese Provisional Publication 48-89979, 48-20785, 48-43130, 48-90391 and 47-33627; matting agents described in, e.g. U.S. Pat. No. 2,992,101 and 2,956,884, British Pat. No. 1,221,980, French Pat. No. 1,395,544 and Japanese Patent Publication 48-43125, particularly silica gel having a grain size of 0.5–20μ and polymethylmethacrylate having a grain size of 0.5–20μ; developing promoters, e.g. benzyl alcohol, a polyoxyethylene series compound and an addition polymer of polyoxyethylene with glycidol.

In accordance with the process of the invention, there is obtained a high contrast silver image. The invention is therefore applicable to various fields wherein a high contrast black and white recording is required. The light-sensitive material of the invention is, for example, applied preferably to a printing- or micro-sensitive material.

The process of the invention for forming a lith type photographic image has superior characteristics which no conventional processes have yet reached.

COMPARISON 1

A silver chloroiodobromide/gelatin emulsion comprising 75 mol % of chloride, 24 mole % of bromide and 1 mole % of iodide having a mean grain size of 0.3μ was sensitized chemically with sulfur- and gold sensitizers. To the emulsion were added 4-hydroxy-6-methyl-1,3,3a,7-tetraazaindene, polyethyleneglycol, (m.w.=1540) oleic acid ether, a merocyanine dye and saponin in amounts of 0.6 g, 0.2 g, 0.15 g and 3 g per mole of silver, respectively. The emulsion was coated on a polyethylene terephthalate support in such amounts that those of the silver and the gelatin were 55 mg and 20 mg per 100 $cm^2$, respectively. Further, on the silver halide emulsion layer was coated gelatin in an amount of 15 mg per 100 $cm^2$ as a protective layer. The above-mentioned material was wedgeexposed with a tungsten lamp through a gray contact screen and then processed according to the following processes:

Developing: changed as below at 30° C.

Fixing: 1 min.

Washing: 1 min.

Drying.

The developing was performed by way of a step developing wherein the developing period is changed, at five minutes intervals, from 15 seconds to three minutes.

Among processing solutions used, the developing solution and the fixing solution had the following compositions, respectively.

| | |
|---|---|
| [Developing solution] | |
| sodium sulfite | 30 g |
| Metol | 7 g |
| sodium carbonate monohydrate | 30 g |
| potassium bromide | 2.5 g |
| sodium hydroxide | 1.5 g |
| water | to make 1 liter (pH = 10.25) |
| [Fixing solution] | |
| ammonium thiosulfate decahydrate | 150 g |
| anhydrous sodium sulfite | 10 g |
| sodium acetate trihydrate | 15 g |
| glacial acetic acid | 17 g |
| water | to make 1 liter (pH = 4.20) |

COMPARISON 2

A material was prepared and processed in the similar manner as in Comparison 1, except that 2,3,5-triphenyl-2H-tetrazolium chloride was added to the emulsion, prior to the coating, in an amount of 2.5 g per mole of silver.

COMPARISON 3

A material was prepared and processed in the similar manner as in Comparison 1, except that a non-diffusible tetrazolium compound obtained from 2,3,5-triphenyl-2H-tetrazolium chloride and sodium diisopropylnaphthalenedisulfonate was added to the emulsion, prior to the coating, in an amount of 1 g per mole of silver by a ultrasonic treatment of the 2% aqueous gelatin solution so that a mean grain size of 0.1μ was obtained.

EXAMPLE 1

A material was prepared in the similar manner as in Comparison 2. In this Example, developing solutions containing respective of the nitrogen-containing heterocyclic compounds [A]–[D] dissolved in triethanolamine was added to the developing solution used in Comparison 1 were employed.

| [nitrogen-containing heyterocyclic compounds] | |
|---|---|
| [A] above-illustrated compound (1) | 100 mg |
| [B] above-illustrated compound (23) | 300 mg |
| [C] above-illustrated compound (24) | 200 mg |
| [D] above-illustrated compound (28) | 260 mg. |

EXAMPLE 2

A material was prepared in the similar manner as in Comparison 3 and processed in the similar manner as in Comparison 1 with the same developing solution as in Example 1 containing the nitrogen-containing heterocyclic compounds [A]–[D].

The adequate developing period and the dot quality at the adequate developing period of materials obtained by the processes of Comparisons 1~3 and Examples 1 and 2 were measured. The results are shown in Table 1.

Table 1

| process | photographic performance | Adequate developing period | Dot quality* |
|---|---|---|---|
| Comparison 1 | | — | 1** |
| Comparison 2 | | 1 min. 25 sec. | 3.0 |
| Comparison 3 | | 1 min. 45 sec. | 3.5 |
| Example 1 | Contg. [A] | 1 min. 10 sec. | 3.2 |
| | Contg. [B] | 35 sec. | 3.0 |
| | Contg. [C] | 45 sec. | 3.0 |
| | Contg. [D] | 40 Sec. | 3.0 |
| Example 2 | Contg. [A] | 1 min. 20 sec. | 3.7 |
| | Contg. [B] | 45 sec. | 3.5 |
| | Contg. [C] | 1 min. | 3.5 |

Table 1-continued

| process | photographic performance | Adequate developing period | Dot quality* |
|---|---|---|---|
| | Contg. [D] | 50 sec. | 3.5 |

*The dot quality means an evaluation value of a microscopic quality of an image obtained through a contact screen. The dot image produces usually a part called "shadow dot" and a part called "highlight dot"; and dots having various sizes are drawn up regularly in the intermediate part between the two parts. The "dot quality" in Table 1 means an evaluation value of a part called "50% dot", i.e. the concentration at which 50% is clear and 50% is developed, and is expressed by a progressive scale. Namely, "5" means to be highly excellent and "1" means to be extremely bad. Generally, the value not less than "3" suffices practical use.
**No dots were formed for three minute's developing.

As is evident from the results shown in Table 1, the process of the invention may shorten the adequate developing period, while maintaining or improving the good dot quality.

COMPARISON 4

A material was prepared and processed in the similar manner as in Comparison 1, using a developing solution having the following composition:

| [developing solution] | |
|---|---|
| sodium sulfite | 60 g |
| sodium ascarbate | 15 g |
| phenidone | 0.3 g |
| sodium carbonate monohydrate | 30 g |
| potassium bromide | 2.5 g |
| disodium ethylenediaminetetraacetate | 1 g |
| 5-nitroindazole | 0.06 g |
| water | to make 1 liter (pH = 10.25) |

COMPARISON 5

A material was prepared in the similar manner as in Comparison 1, except that 2-p-iodophenyl-3-p-nitrophenyl-5-phenyl-2H-tetrazolium chloride was added to the emulsion, prior to the coating, in an amount of 4 g per mole of silver.

The material was wedge-exposed in the similar manner as in Comparison 1 and processed in the similar manner as in Comparison 4.

COMPARISON 6

A material was prepared in the similar manner as in Comparison 1, except that a non-diffusible tetrazolium compound obtained from 2-p-iodophenyl-3-p-nitrophenyl-5-phenyl-2H-tetrazolium chloride and sodium diethylhexylsuccinate sulfonate was added to the emulsion in an amount of 2 g per mole of silver by way of an ultrasonic treatment of 2% aqueous gelatin solution so that the mean grain size of 0.1$\mu$ was obtained.

The material was wedge-exposed in the similar manner as in Comparison 1 and processed in the similar manner as in Comparison 4.

EXAMPLE 3

A material was prepared and processed in the similar manner as in Comparison 5. In this example, developing solutions containing respective of the nitrogen-containing heterocyclic compounds [E]~[H] of the invention, dissolved in diethanolamine was added to the developing solution used in Comparison 4, were employed.

| [nitrogen-containing heterocyclic compounds] | |
|---|---|
| [E] above-illustrated compound (6) | 300 mg |
| [F] above-illustrated compound (13) | 350 mg |
| [G] above-illustrated compound (37) | 250 mg |
| [H] above-illustrated compound (2) | 380 mg. |

EXAMPLE 4

A material was prepared and processed in the similar manner as in Comparison 6. In this example, the developing solutions containing the nitrogen-containing heterocyclic compounds [E]~[H] of the invention, used in Example 3, were employed.

The adequate developing period and the dot quality at the adequate developing period of materials obtained by the processes of Comparisons 4~6 and Examples 3 and 4 were measured in accordance with the same criteria as those mentioned in Table 1. The results as shown in Table 2.

Table 2

| process | photographic performance | Adequate developing period | Dot quality |
|---|---|---|---|
| Comparison 4 | | — | 1* |
| Comparison 5 | | 1 min. 45 sec. | 3.0 |
| Comparison 6 | | 2 min. 15 sec. | 3.5 |
| | Contg. [E] | 40 sec. | 3.0 |
| | Contg. [F] | 55 sec. | 3.5 |
| Example 3 | Contg. [G] | 50 sec. | 3.0 |
| | Contg. [H] | 1 min. | 3.0 |
| | Contg. [E] | 50 sec. | 3.5 |
| Example 4 | Contg. [F] | 1 min. | 3.5 |
| | Contg. [G] | 55 sec. | 3.5 |
| | Contg. [H] | 1 min. 5 sec. | 3.7 |

*No dots were obtained within 3 minute's developing period.

As is evident from the results shown in Table 2, the process of the invention may shorten the adequate developing period, while maintaining or improving the good dot quality.

EXAMPLE 5

A material was prepared and wedge-exposed in the similar manner as in Comparison 2.

The material was processed by the following processes:

Pre-bath: 1 min. (30° C.)
Developing: changed in the similar manner as in Comparison 1 (30° C.)
Fixing: 1 min.
Washing: 1 min.
Drying.

The pre-bath used for the process consisted of the following composition and the under-mentioned nitrogencontaining heterocyclic compound [I] [L] dissolved in triethanolamine.

The developing solution and fixing solution used had the same compositions as in Comparison 1.

| [Pre-bath] | |
|---|---|
| disodium ethylenediaminetetraacetate | 1 g |
| anhydrous sodium sulfite | 10 g |
| triethanolamine | 20 g |
| water | to make 1 liter (pH = 10.0) |

-continued

| | |
|---|---|
| [nitrogen-containing heterocyclic compounds] | |
| [I] above-illustrated compound (5) | 150 mg |
| [J] above-illustrated compound (40) | 150 mg |
| [K] above-illustrated compound (27) | 100 mg |
| [L] above-illustrated compound (7) | 100 mg. |

EXAMPLE 6

A material was prepared in the similar manner as in Comparison 3 and processed in the similar manner as in Example 5.

The adequate developing period and the dot quality at the adequate developing period of the materials obtained in the processes of Examples 5 and 6 were measured in accordance with the same criteria as those mentioned in Table 1. The results are shown in Table 3.

Table 3

| process | photographic performance | Adequate developing period | Dot quality |
|---|---|---|---|
| Example 5 | Contg. [I] | 1 min. 20 sec | 3.0 |
| | Contg. [J] | 1 min. 5 sec. | 3.0 |
| | Contg. [K] | 50 sec. | 3.0 |
| | Contg. [L] | 55 sec. | 3.0 |
| Example 6 | Contg. [I] | 1 min. 25 sec. | 3.7 |
| | Contg. [J] | 1 min. 10 sec. | 3.5 |
| | Contg. [K] | 55 sec. | 3.5 |
| | Contg. [L] | 1 min. | 3.5 |

As is evident from the results shown in Table 3, the process of the invention may shorten the adequate developing period, while maintaining the good dot quality, also when the nitrogen-containing heterocyclic compound of the invention is added to the pre-bath.

COMPARISON 7

A material was prepared in the similar manner as in Comparison 2 and processed in the similar manner as in Comparison 1. In this Comparison, developing solutions having the following composition and added the following developing agents [1]~[7] were employed:

| | | | |
|---|---|---|---|
| [Developing solution] | | | |
| anhydrous sodium sulfite | | 30 g | |
| developing agent | | (in amounts shown in [1] ~ [7] below) | |
| sodium carbonate monohydrate | | 30 g | |
| potassium bromide | | 2.5 g | |
| 5-nitrobenzotriazole | | 0.06 g | |
| water | | to make 1 litre (pH = 10.25) | |
| [Developing agents] | | | |
| [1] Metol | 3.5 g, | hydroquinone | 10 g |
| [2] phenidone | 0.3 g, | hydroquinone | 10 g |
| [3] phenidone | 0.3 g, | sodium ascorbate | 18 g |
| [4] phenidone | 3 g, | p-aminophenol | 15 g |
| [5] phenidone | 0.6 g, | pyrogallol | 15 g |
| [6] Metol 8 g | | | |
| [7] p-phenylenediamine | 0.2 g, | hydroquinone | 7 g. |

COMPARISON 8

A material was prepared and wedge-exposed in the similar manner as in Comparison 6.

The material was processed with the developing solutions containing the developing agents [1]~[7], respectively, as in Comparison 7.

EXAMPLE 7

A material was prepared and wedge-exposed in the similar manner as in Comparison 2.

The material was processed with the developing solutions containing the developing agents [1]~[7], respectively, as in Comparison 7. The developing solutions further contained 60 mg of the above-illustrated compound (1) as the nitrogencontaining heterocyclic compound of the invention.

EXAMPLE 8

A material was prepared and wedge-exposed in the similar manner as in Comparison 6 and processed in the similar manner as in Example 7.

The adequate developing period and the dot quality at the adequate developing period of the materials obtained by the processes of Comparisons 7 and 8 and Examples 7 and 8 were measured in accordance with the same criteria as those mentioned in Table 1.

The results are shown in Table 4.

Table 4

| Developing agent contained in the developing solution | Comparison 7 | | Comparison 8 | |
|---|---|---|---|---|
| | Adequate developing period | Dot quality | Adequate developing period | Dot quality |
| [1] | 1 min. 20 sec. | 3.0 | 1 min. 30 sec. | 3.5 |
| [2] | 1 min. 30 sec. | 3.0 | 1 min. 40 sec. | 3.5 |
| [3] | 1 min. 40 sec. | 3.0 | 1 min. 50 sec. | 3.5 |
| [4] | 2 min. | 3.0 | 2 min. 30 sec. | 3.5 |
| [5] | 1 min. 30 sec. | 3.0 | 2 min. | 3.5 |
| [6] | 1 min. 5 sec. | 3.0 | 1 min. 15 sec. | 3.5 |
| [7] | 1 min. 10 sec. | 3.0 | 1 min. 20 sec. | 3.5 |

| Developing agent contained in the developing solution | Example 7 | | Example 8 | |
|---|---|---|---|---|
| | Adequate developing period | Dot quality | Adequate developing period | Dot quality |
| [1] | 50 sec. | 3.0 | 1 min. 10 sec. | 3.7 |
| [2] | 1 min. | 3.0 | 1 min. 20 sec. | 3.7 |
| [3] | 55 sec. | 3.2 | 1 min. 10 sec. | 3.5 |
| [4] | 50 sec. | 3.0 | 1 min. 30 sec. | 3.5 |
| [5] | 50 sec. | 3.2 | 1 min. | 3.7 |
| [6] | 40 sec. | 3.0 | 50 sec. | 3.5 |
| [7] | 55 sec. | 3.0 | 1 min. 5 sec. | 3.5 |

As is evident from the results shown in Table 4, the process of the invention in which a light-sensitive silver halide photographic material containing a tetrazolium compound is processed with a developing solution containing a nitrogen-containing heterocyclic compound of the invention affords a rapid process by shortening the developing period, while maintaining or improving the superior dot quality.

What is claimed is:

1. A process for forming a high contrast silver image which comprises treating a light-sensitive silver halide photographic material provided with a hydrophilic colloidal layer including a silver halide emulsion layer, coated on a support and containing at least one tetrazolium compound selected from the group consisting of those having the following general formula I, II and III, and a compound comprising said tetrazolium compound and an anionic surfactant, after imagewise exposure, with at least one liquid selected from the group consisting of a developer, and a processing solution prior to the developing, which liquid contains at least a nitrogen-containing heterocyclic compound selected from the group consisting of those having the following general formula IV or V general formula I :

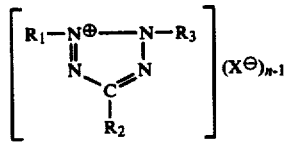

general formula II :

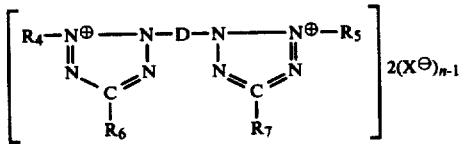

general formula III :

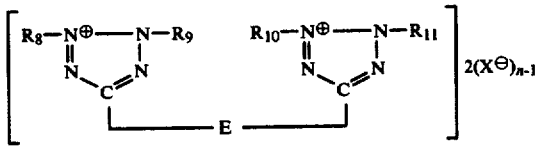

where $R_1$, $R_3$, $R_4$, $R_5$, $R_8$, $R_9$, $R_{10}$ and $R_{11}$ individually represent groups selected from alkyl, allyl, phenyl, naphthyl and heterocyclic groups, which groups may form a metal chelate or complex; $R_2$, $R_6$ and $R_7$ individually represent groups selected from allyl, phenyl, napthyl, heterocyclic, alkyl, hydroxyl, carboxyl or a salt thereof, carboxyalkyl, amino, mercapto and nitro, hydrogen; D is a divalent arylene group; E represents a group selected from alkylene, arylene and aralkylene groups; $X^{\ominus}$ is an anion; and n is 1 or 2, provided that when the compound forms an intramolecular salt, n is 1, general formula IV :

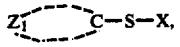

general formula V :

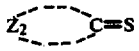

wherein, $Z_1$ and $Z_2$ each represent an atom or an atomic group which forms a heterocyclic ring selected from the group consisting of imidazoline-, imidazole-, imidazolone-, pyrazoline-, pyrazole-, pyrazolone-, oxazoline-, oxazole-, oxazolone-, thiazoline-, thiazole-, thiazolone-, selenazoline-, selenazole-, selenazolone-, oxadiazole-, thiadiazole-, triazole-, benzimidazole-, benzotriazole-, indazole-, benzoxazole-, benzothiazole-, benzoselenazole-, pyrazine-, pyrimidine-, pyridazine-, triazine-, oxazine-, thiazine-, tetrazine-, quinazoline-, phthalazine- and polyazaindene rings.

2. A process for forming a high contrast silver image as claimed in claim 1, wherein the nitrogen-containing heterocyclic compound is a compound selected from the group consisting of 2-mercaptobenzoxazole, 2-mercaptobenzimidazole or 2-mercaptobenzothiazole.

3. A process for forming a high contrast silver image as claimed in claim 2, wherein the nitrogen-containing heterocyclic compound is 2-mercaptobenzoxazole.

4. A process for forming a high contrast silver image as claimed in claim 2, wherein the nitrogen-containing heterocyclic compound is 2-mercaptobenzimidazole.

5. A process for forming a high contrast silver image as claimed in claim 2, wherein the nitrogen-containing heterocyclic compound is 2-mercaptobenzothiazole.

6. A process for forming a high contrast silver image as claimed in claim 1, wherein the content of the nitrogen-containing heterocyclic compound substituted with at least a mercapto, thioketone or thioether group, contained in the developing solution and/or a processing solution prior to the developing, is from 0.5 mg–2 g per liter.

7. A process for forming a high contrast silver image as claimed in claim 1, wherein the silver halide contained in the silver halide emulsion layer comprises is composed of an average grain size of from 0.05–0.8μ.

8. A process for forming a high contrast silver image as claimed in claim 1, wherein the anion is selected from the group of a higher alkylbenzenesulfonate anion, a higher alkylsulfate ester anion, a dialkylsulfosuccinate anion, a polyetheralcoholsulfonate ester anion, a higher fatty acid anion, a polymeric anion or an alkylnaphthalene sulfonate anion.

9. A process for forming a high contrast silver halide image as claimed in claim 1, wherein the tetrazolium compound is a compound represented by the general formula [I], and $R_1$, $R_2$ and $R_3$ individually represent phenyl groups in the formula.

10. A process for forming a high contrast silver image as claimed in claim 1, wherein the tetrazolium compound is a compound obtained from 2,3,5-triphenyl-2H-tetrazolium and diisopropylnaphthalene-disulfonate, from 2,3,5-triphenyl-2H-tetrazolium and diethylhexylsuccinate disulfonic acid, or from 2-p-iodophenyl-3-p-nitrophenyl-5-phenyl-2H-tetrazolium chloride and diethylhexyl succinate sulfonic acid.

11. A process for forming a high contrast silver image as claimed in claim 1, wherein the developing solution contains, as the developing agent, at least Metol, hydroquinone or phenidone.

12. A process for forming a high contrast silver image as claimed in claim 9, wherein the developing solution contains sulfite ion in an amount of from $1\times10^{-2}$ to $1\times10^{-1}$ mole per liter.

13. A process for forming a high contrast silver image as claimed in claim 9, wherein the developing solution has a pH value of from 8.5 to 12.

* * * * *